US007506655B2

(12) United States Patent
Assmann

(10) Patent No.: US 7,506,655 B2
(45) Date of Patent: Mar. 24, 2009

(54) DISHWASHER

(75) Inventor: Walter Assmann, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 382 days.

(21) Appl. No.: 11/100,786

(22) Filed: Apr. 7, 2005

(65) Prior Publication Data

US 2005/0224101 A1 Oct. 13, 2005

(30) Foreign Application Priority Data

Apr. 7, 2004 (DE) ..... 10 2004 017 612

(51) Int. Cl.
*B08B 3/00* (2006.01)

(52) U.S. Cl. ..... 134/56 D; 134/57 D; 134/58 D; 134/99.2

(58) Field of Classification Search ..... 134/56 D, 134/57 D, 58 D
See application file for complete search history.

(56) References Cited

U.S. PATENT DOCUMENTS 3,828,975 A * 8/1974 Robandt et al. ..... 222/651
6,598,611 B1 7/2003 Durazzani et al.
2004/0177654 A1* 9/2004 Marks ..... 68/13 A

FOREIGN PATENT DOCUMENTS

| | | | |
|---|---|---|---|
| DE | 692 01 234 T2 | | 6/1993 |
| DE | 69201234 | * | 6/1993 |
| DE | 102 04 548 A1 | | 8/2003 |
| DE | 102 01 792 C1 | | 9/2003 |
| DE | 103 11 126 A1 | | 9/2004 |
| EP | 0545127 | | 6/1993 |
| EP | 1334688 | | 8/2003 |

* cited by examiner

*Primary Examiner*—Michael Barr
*Assistant Examiner*—Jason Heckert
(74) *Attorney, Agent, or Firm*—Darby & Darby

(57) ABSTRACT

A dishwasher with a double-walled door pivotal between open and closed states and provided between its walls with a salt receiving container provided with a vent opening part of its upper wall extending between the walls of the door. The vent opening is connected with a vent channel at least part of which is narrowed by a ridge extending partly across the channel and which extends over the salt receiving container and along a lateral wall thereof to a lower section for providing access to ambient air.

4 Claims, 3 Drawing Sheets

DISHWASHER

FIELD

The invention, in general, relates to a dishwasher and, more particularly, to a dishwasher of the kind provided with a dish washing chamber closed by a door and a water softening unit provided with an ion exchanger and a salt container for the preparation of brine, the salt container being disposed in an intermediate chamber adjacent to the door and chargeable through a closable salt fill opening in its front wall adjacent to the inner surface of the door.

BACKGROUND

A dishwasher of this kind is generally known from German patent specifications DE 102 01 792 C1 and DE 102 04 548 A1.

For the prevention of lime deposits on dishes it is known to soften the water entering the dish washing chamber of a dishwasher by feeding it through an ion exchanger. In household dishwashers, the ion exchanger usually is provided with a mixed bed resin, the softening components of which will become exhausted and require replenishment by a salt solution. For receiving a supply of salt sufficient for several regeneration cycles, a water softener is provided with a salt container in addition to the ion exchanger. It is known and generally practiced in commercial dishwashers to arrange the salt container at the bottom of the housing of the apparatus and to charge or fill it through an opening in the bottom panel of the washing chamber. For a user, this is uncomfortable or inconvenient since it compels him to reach deeply into the washing chamber. The disadvantage is greater still when lacking salt is detected while the machine is filled with dishes. In such a case, the lower dish basket must first be unloaded before it can may be removed from the washing chamber to provide free access to the filling opening of the salt container. To avoid these disadvantages, German patent specification DE 102 01 792 C1 and DE 102 04 548 A1 propose to position the salt container within the door of the apparatus for filling it in a simple manner through a salt feed opening at the interior surface of the door. Owing to the narrow space between the inner and outer surface panels of the door, the design of such a salt container has to be very thin. Because of the arrangement of the salt fill opening in the front wall which is vertically disposed when the door is closed during operation, the salt container cannot be filled completely with salt or fluid. For that reason an air cushion will form above the brine. During operation of the dishwasher the air cushion will expand as a result of a rise in temperature.

German patent specification DE 692 01 234 discloses a brine preparation arrangement integrated into the door of an apparatus which at the output of the regenerating water dispenser allows a temperature-affected medium to escape through a channel leading to the interior of the washing chamber. The output tube of the channels forms a syphon which prevents balancing of the air between the salt container and the environment.

Another problem arises in handling dishwashers where it is necessary for purposes of a repair to change their upright operating disposition and place the machine on its back, one of its side surfaces, or even on its top surface, or where the position of the machine is changed during transport. In such cases it is practically impossible to prevent the brine from escaping from the salt container through the vent opening.

SUMMARY

It is thus an aspect of the invention to provide for venting of the salt container while preventing the brine from escaping while the apparatus is being moved.

In accordance with the invention, the object is accomplished by a dishwasher the salt container of which is provided with a separate vent opening which is located in the wall disposed at the top when the door is closed during operation and by the vent opening leading to a vent channel disposed above the salt container and providing for a connection between the interior of the salt container and the environment.

BRIEF DESCRIPTION OF THE DRAWINGS

The features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION

Figure 1:
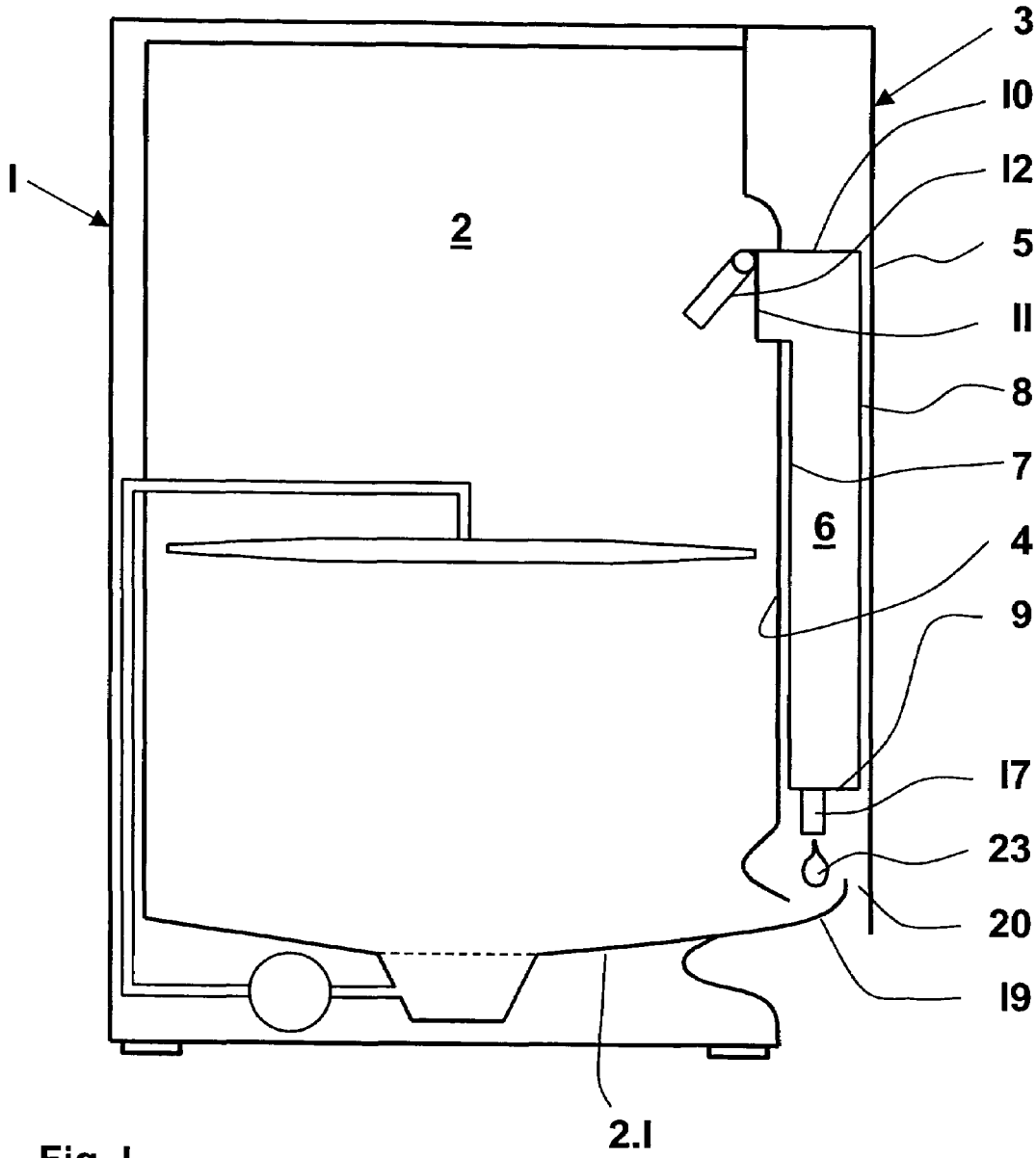
FIG. 1 is a schematic side elevation in section of a dishwasher.

The advantages derived from the invention are, among others, that the salt container is provided with a separate vent which, during operation while the door is closed, is disposed above the fluid level of the brine in the salt container. At the formation of increased pressure in the salt container, excess air is vented directly without any quantities of brine entering into the wash chamber as a result of their displacement. Another advantage results from the fact that there is no opening directed to the interior of the washing chamber. In this manner, the opening cannot be plugged up by the brine and contaminations contained therein, and the brine is prevented from entering into the salt container.

In an advantageous embodiment the vent opening in the top wall extends from a front wall adjacent to the interior or exterior surface of the door over only a partial section of the width of the top wall. The depth of the opening may be dimensioned such that in a position of the salt container in which the front wall is disposed horizontally and on top, the volume below the opening corresponds at least to the volume formed below the salt fill opening when the door is closed in the operative position. This prevents brine from escaping from the salt container when the dishwasher lies on either its back or front surface (depending upon the disposition of the opening).

It is advantageous to arrange the vent opening in the area of the top wall adjacent to the interior surface of the door. Not only does this prevent brine from escaping when the dishwasher lies on the side of its door, but the door is protected against an escape of brine as well when in its more frequently occurring horizontal open position.

It is also advantageous additionally to use a ridge for narrowing a section of the channel adjacent to the top wall to a gap extending from the front wall opposite the vent opening over a partial section of the depth of the top wall. The height of the ridge has to be dimensioned such that when the salt container assumes a position in which this front wall is disposed horizontally and on top, the volume below the opening corresponds at least to the volume formed below the salt fill opening in the operating position when the door is closed. This prevents the brine from escaping from the salt container when the dishwasher lies on its back surface or on its door surface (or when the door is open).

In an advantageous embodiment the vent channel extends at least approximately to the diagonally opposite area of the salt container. In this manner, an escape of the brine is prevented when the dishwasher lies on its side surface or on its top surface (as may be required when its circulating pump needs to be removed). In this embodiment it is of further advantage to extend the vent channel around the salt container along its covering wall and a side wall approximately to its bottom region. This avoids narrowing the salt container and facilitates sliding of the salt to the lower region. In this connection, it is efficient to locate the vent opening at the beginning of the channel.

Furthermore, it is efficient to provide a stub at the end of the vent channel opposite the vent opening. In an advantageous embodiment the bottom of the washing chamber may then be widened to a door channel extending at least in part below the door, and in an operative state the output stub may feed into the door channel when the door is closed. In this manner, any small quantity of brine cannot escape to the outside when the dishwasher is moved from an upside-down disposition by way of the side where the output stub is located to its operating disposition.

It is also advantageous to fabricate the salt container with its vent channel and salt fill opening of plastic. It would provide for integrated airing and venting which can be economically produced.

FIG. 1 is a schematic side view of a dishwasher 1 provided with a washing chamber 2 which may be closed by a pivoting door 3. The door 3 is fabricated of two sheet-metal door panels 4 and 5. The outwardly facing panel 5 may be provided with a decorative plate matching the decor of other kitchen furniture. Between the door panels 4 and 5 there is provided a salt container 6 for preparing brine for a water softening device integrated into the dishwasher. The brine serves to regenerate the softener which may be a mixed bed resin in an ion exchanger.

Figure 2:
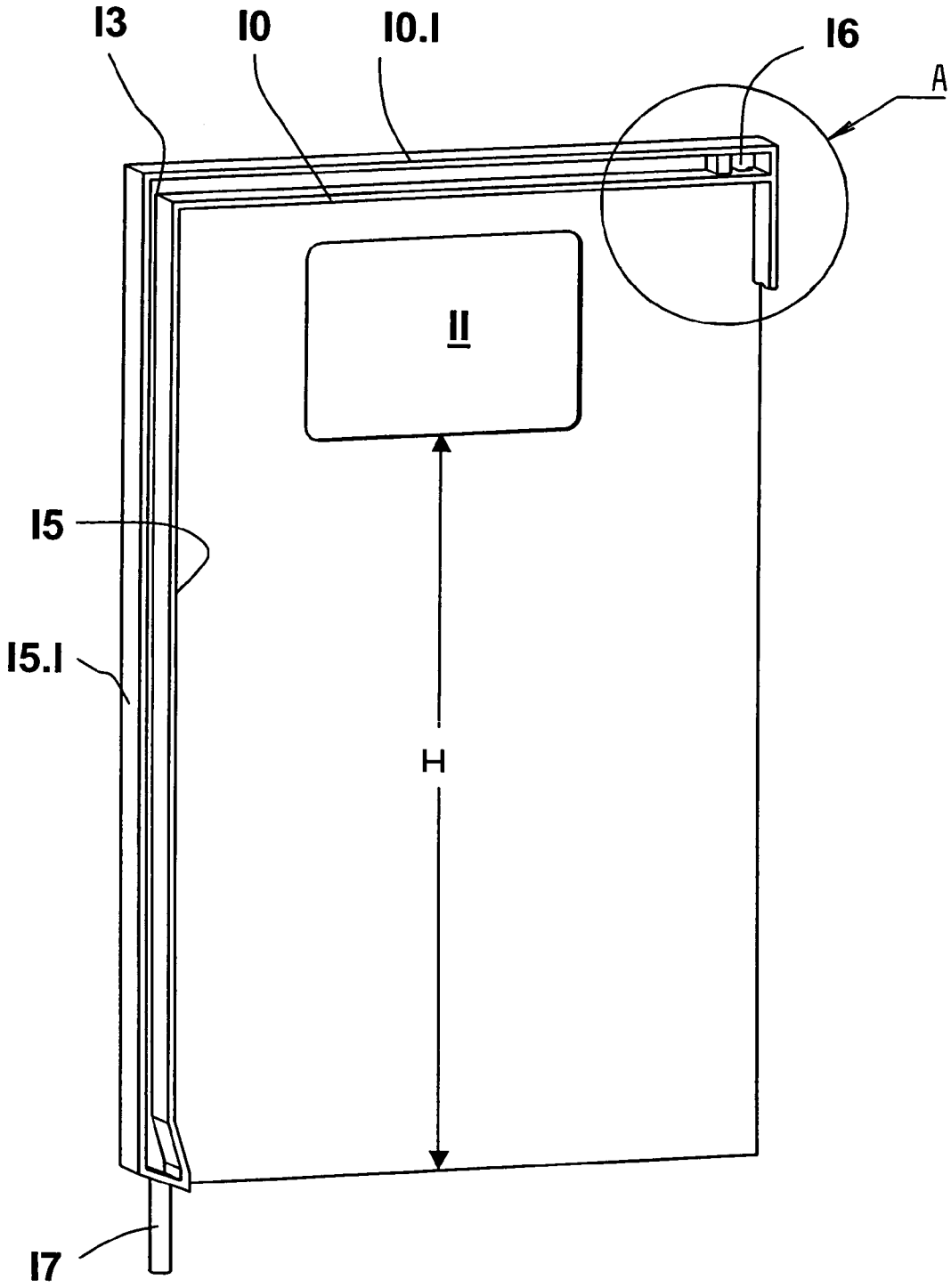
FIG. 2 is a perspective view of a vent channel around the salt container indicated in the door of the apparatus.

FIG. 2 depicts a salt container of simplified parallelepiped structure. Alternatively, the salt container may be shaped similarly to the one known from German patent specification DE 103 11 126 A1. The container can include two front walls 7 and 8 respectively facing the door panels 4 and 5, a bottom wall 9, a narrow top wall 10 and two narrow side walls 14 and 15 (see FIGS. 2 and 3). In its upper section, the front wall 7 facing the internal door panel 4 is provided with a salt fill opening 11 which may be closed by a cover 12 hingedly mounted on the internal door panel 4.

A vent channel 13 extends around the salt container 6 along the entire top wall 10 and along a side wall 15 down to the bottom area. For this purpose, the salt container 6 is, in these areas, provided with double walls with the space intermediate these two walls 10 and 10.1 and the two walls 15 and 15.1 constituting the channel 13. A vent opening 16 in the top wall 10 provides a permanent connection between the interior of the salt container 6 to the environment or ambient air 20. The outlet to the environment 20 may be seen more clearly in FIG. 1 in which a channel stub 17, below the salt container 6, points towards a lower door channel 19. The door channel 19 is constituted by a widened section 2.1 at the bottom of the wash chamber 2 which extends to below the door 3 and allows for a return flow of condensation water or brine, indicated by a drop 23, to the wash chamber 2.

Figure 3:
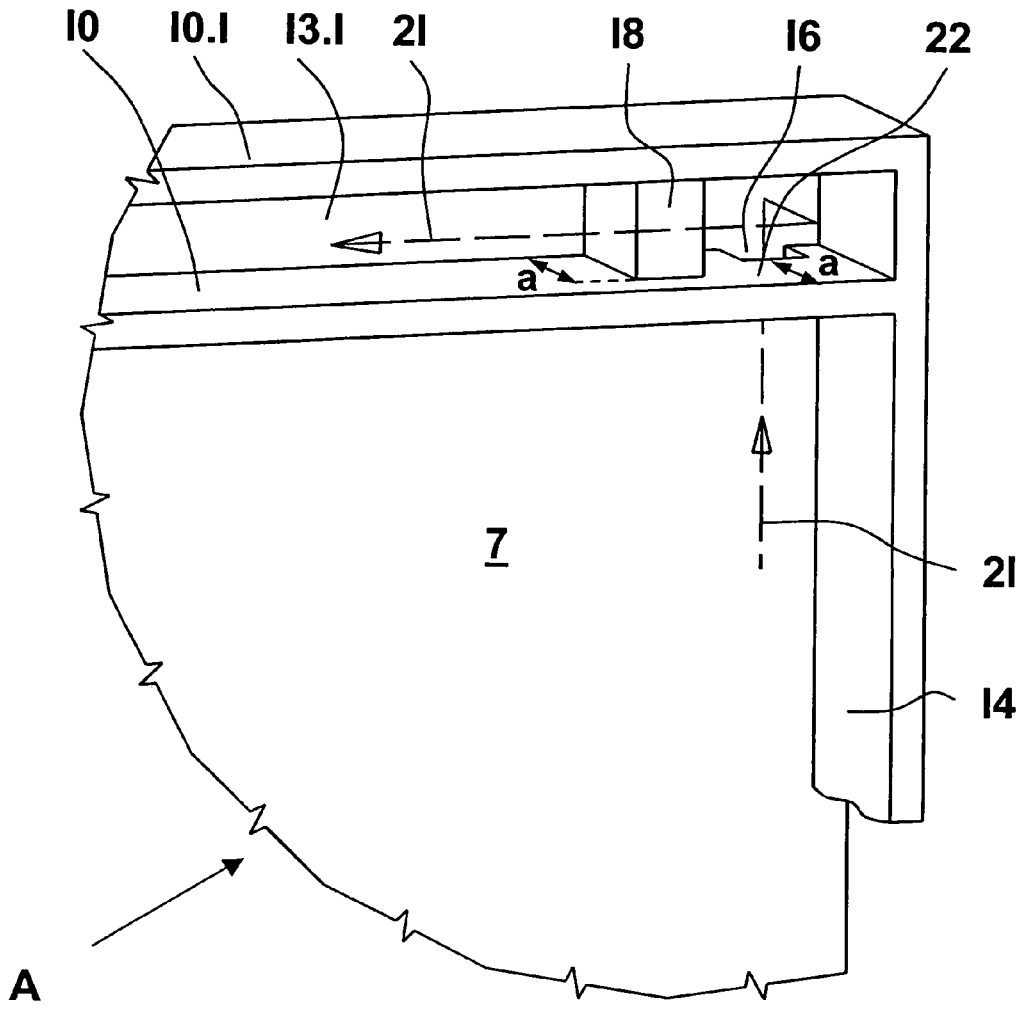
FIG. 3 is a view in detail of the input opening of the channel path.

From FIGS. 2 and 3 in particular, the perspective view clearly shows that a labyrinth-like flow path 21 is provided for accommodating brine escaping from the salt container 6 when the door 3 is pivoted or the dishwasher 1 is tilted. The flow path 21 is shown by a dashed line to show the path to be followed by the brine in order to escape. Thus, the vent opening 16 is extending from the front wall 7 over a partial section only of the top wall 10. Therefore, when the salt container 6 assumes a horizontal disposition, for instance, when the door 3 is open, a volume or empty space defined by the bottom surface of the front wall 8 and the width a of the remaining top wall section 22. The volume has to be at least equal to the volume defined by the ground surface of the bottom wall 9 and the height H of the front wall 7 up to the lower margin of the salt fill opening 11 and thus to the maximum holding capacity of the salt container 6. A ridge 18 which narrows the cross-section of the channel section 13.1 to a gap to form the aforesaid labyrinth must also be of width a, provided the two basic surfaces of the front walls 7 and 8 are equal in size. This ensures the amount of brine corresponding to the maximum holding capacity to remain in the salt container 6, even if the dishwasher 1 is placed on its back surface, and not to flow beyond the ridge 18 into the vent channel 13.

In an improved embodiment of the invention, the salt container 6 mounted between the interior and exterior door panels 4 and 5, is structured as a molded plastic component integral with the vent channel 13 and the salt fill opening 11.

What is claimed is:

1. A dishwasher comprising:

a wash chamber;

a door for selectively opening and closing the wash chamber, the door comprising an interior door panel, an exterior door panel defining an intermediate space between the interior and exterior door panels; and a salt receiving container mounted in the intermediate space and comprising:

a front wall facing the interior door panel and having an opening therein for filling the salt into the container, a rear wall facing the exterior door panel, a top wall disposed in an upper section of the door in its closed state, a venting channel extending over the salt receiving container and providing a connection between an interior of the salt receiving container and ambient air, a vent opening in the top wall connecting the vent channel to the interior of the salt receiving container, and a ridge disposed in the venting channel extending from the front wall toward the rear wall and narrowing a cross section of the venting channel at a distal end of the ridge.

2. The dishwasher recited in claim 1 wherein the vent opening extends from the front wall only partially across the top wall.

3. The dishwasher recited in claim 1 wherein the venting channel extends along a top wall and down a lateral wall to a bottom of the salt receiving container.

4. The dishwasher recited in claim 1 wherein the vent opening is disposed at an end of the venting channel.

* * * * *